United States Patent [19]

Barlow

[11] Patent Number: 4,571,751

[45] Date of Patent: Feb. 25, 1986

[54] DRAIN ASSEMBLY WITH SYNTHETIC RESIN LOCK NUT AND COUPLING ELEMENTS

[76] Inventor: J. Bruce Barlow, 259 Woodpond Rd., Glastonbury, Conn. 06033

[21] Appl. No.: 685,407

[22] Filed: Dec. 24, 1984

[51] Int. Cl.[4] ..... A47K 1/14

[52] U.S. Cl. ..... 4/288

[58] Field of Search ..... 4/191, 204, 286–292

[56] References Cited

U.S. PATENT DOCUMENTS

| | | | |
|---|---|---|---|
| 2,278,566 | 4/1942 | Schaible . | |
| 2,747,896 | 5/1956 | Quillinan . | |
| 2,961,914 | 11/1960 | Young | 4/288 |
| 3,104,400 | 9/1963 | Lantz et al. | 4/287 |
| 3,327,326 | 6/1967 | Friedman | 4/286 |
| 3,397,902 | 8/1968 | Dutcher | 4/288 |
| 3,411,628 | 11/1968 | Mason | 4/287 |
| 3,509,587 | 5/1970 | Fins | 4/288 |
| 3,588,928 | 6/1971 | Hiertz | 4/287 |
| 3,700,361 | 10/1972 | Deeke | 4/288 |
| 3,711,874 | 1/1973 | Gajer | 4/287 |
| 3,800,339 | 4/1974 | Bergin | 4/286 |
| 3,881,201 | 5/1975 | Richards | 4/288 |

*Primary Examiner*—Stephen Marcus
*Assistant Examiner*—Leo James Peters

[57] ABSTRACT

A drain assembly for sinks, tubs, basins and similar vessels utilizes a strainer body which is of thin wall metal construction, in combination with a plastic housing subassembly, to provide significant savings in manufacturing costs. The spout portion of the stainer body has a thread of relatively coarse pitch, which preferably makes less than a full revolution thereabout and cooperates with an internally threaded metal insert, the latter being permanently affixed within an enlarged portion of the plastic housing sleeve.

9 Claims, 4 Drawing Figures

DRAIN ASSEMBLY WITH SYNTHETIC RESIN LOCK NUT AND COUPLING ELEMENTS

BACKGROUND OF THE INVENTION

Assemblies consisting of an internal strainer body and an external housing are conveniently utilized in drains of sinks, tubs, basins and like vessels for connection to the discharge conduit. Such assemblies are disclosed in the art in various forms, typical of which are the constructions shown in the following U.S. Pat. Nos. 2,278,566 to Schaible; 2,961,914 to Young; 3,700,381 to Deeke; and 3,881,201 to Richards. As indicated by these patents, it is common practice to install the assembly by clamping the portion of the vessel surrounding its drain opening between cooperating flanges on the inner and outer members, although other fastening means have also been employed. For example, a screw-mounted supporting ring arrangement is described in Friedman U.S. Pat. No. 3,327,326, which also shows the use of a series of nibs on the neck portion of the cylindrical drain body as a quick disconnect arrangement for locking the body in position upon the supporting ring.

Regardless of the form of the unit, it is of course desirable to minimize complexity, and the cost of manufacture. Moreover, any such cost reduction should obviously not be accompanied by diminished quality or durability, and should not entail any substantial sacrifice in convenience of use or in ease of installation.

Accordingly, it is the primary object of the present invention to provide a novel drain assembly for installation in a sink, tub, basin or like vessel, which can be manufactured at substantially less cost than comparable constructions provided heretofore.

It is also an object of the invention to provide such an assembly in which no reduction in quality, durability, attractiveness, or facility of installation or use is entailed, as compared to similar prior art assemblies.

SUMMARY OF THE DISCLOSURE

It has now been found that the foregoing and related objects of the invention are readily attained in a drain assembly including a one-piece drain, or strainer, body of thin wall construction, and an external, two-piece housing. The housing is comprised of a sleeve member, integrally formed of a synthetic resinous material, and a ring-shaped insert firmly secured therewithin, the insert usually being made of a metal, such as aluminum. The strainer body used in the assembly is comprised of a generally cylindrical sidewall portion, having a circumferential flange portion extending outwardly about its upper end and a reduced diameter tubular spout portion at its lower end, the latter having integral thread means formed thereon for engagement with the insert of the housing. The sleeve member of the housing is dimensioned and configured to seat the strainer body, and it has flange and sidewall portions corresponding to those of the strainer body and a tail portion corresponding to the spout portion thereof. The ring-shaped insert is disposed coaxially within the tail portion of the sleeve member and adjacent the sidewall portion, and is internally threaded (preferably with a coarse thread of generally square cross-section) to engage the thread means of the spout portion and permit tightening of the housing thereupon. An externally threaded section is also provided on the tail portion downwardly of the location at which the insert is disposed, to enable connection of a drain conduit to the assembly. The flange portions of the strainer body and sleeve member are adapted to bear upon the wall of the vessel in which the assembly is installed, about the drain opening therein, to enable secure and effective mounting.

In the preferred embodiments, the drain body will be fabricated from a single piece of light gauge metal sheet (such as of stainless steel or brass), and the thread means will extend for not more than a single revolution about the spout portion thereof; the thread means will normally extend along a helical path, and will beneficially consist of a plurality of discrete segments spaced from one another. The sidewall portion of the strainer body will usually have a downwardly tapered annular throat section leading to the spout portion, and the external sleeve member will have a corresponding throat section leading to the tail portion thereof. Advantageously, the housing sleeve member will be configured to provide an enlarged section upwardly of its externally threaded section, within which the ring-shaped insert will be disposed; the inside diameters of the two sections will desirably be substantially the same, so as to provide a passageway through the tail portion which is of generally uniform diameter. To facilitate engagement of wrenches for tightening of the housing upon the drain body, the sidewall of the housing will beneficially be formed with axial ribs, and the enlarged section of its tail portion will beneficially be molded with a polygonal exterior configuration.

DETAILED DESCRIPTION OF THE ILLUSTRATED EMBODIMENT

Figure 1:
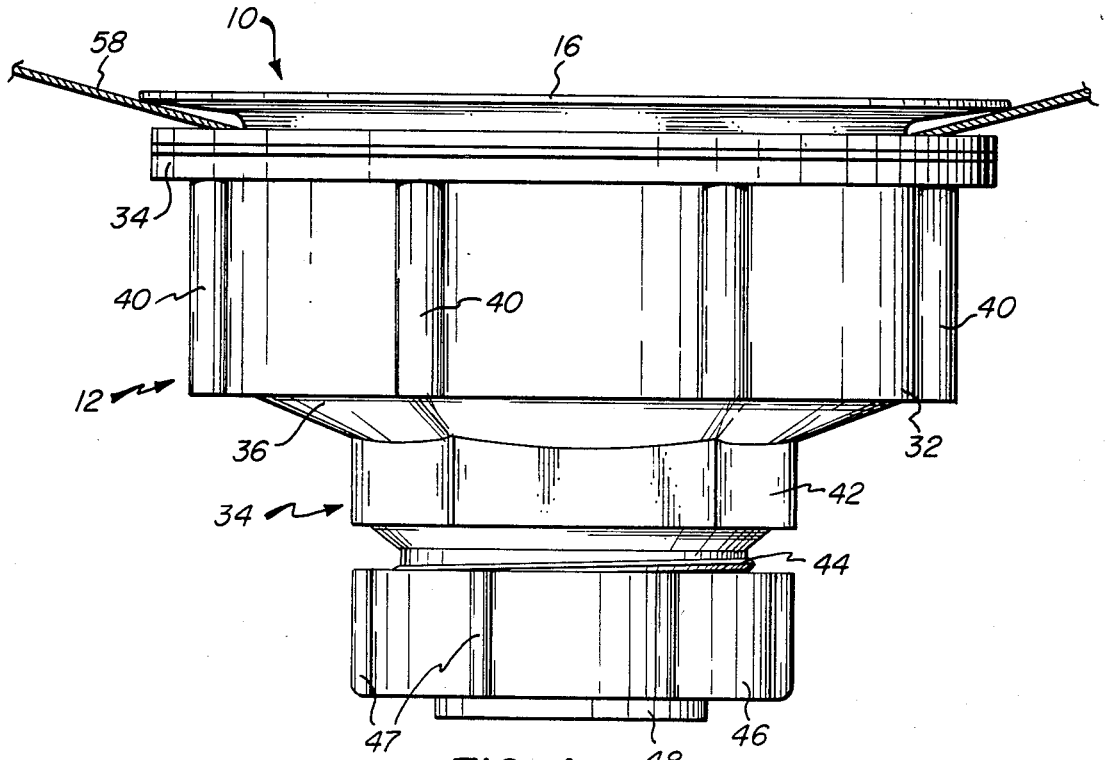
FIG. 1 is a side elevational view of the assembly of the invention installed within the drain opening of a sink, the latter being fragmentarily illustrated in cross section.

Turning now in detail to the appended drawings, therein illustrated is a drain assembly embodying the present invention and consisting of an internal, one-piece strainer body, generally designated by the numeral 10, and an external sleeve or housing subassembly, generally designated by the numeral 12. As can be seen, the strainer body 10 is of thin wall construction, and may be made by deep-drawing a sheet of metal (typically, 0.025 inch material). The body 10 is comprised of a generally cylindrical sidewall portion 14 having a radially outwardly extending circumferential flange portion 16 at its upper end, and a reduced diameter tubular spout or neck portion, generally designated by the numeral 18, at its lower end; a conical shoulder portion 19 interconnects the sidewall portion 14 and the spout portion 18, providing a transition section therebetween.

The spout portion 18 consists, in turn, of a generally cylindrical sidewall element 20 and a transversely extending bottom wall element 22, which is perforated (at locations not visible) to provide drainage apertures from the strainer body. The bottom wall element 22 is also formed with a centrally located slot 24, within which is received the pin 26 of a conventional crumb basket/stopper unit, generally designated by the numeral 28; of course, other types of baskets and means for seating them can be substituted if so desired.

Four thread segments 30 are formed (such as by rolling or stamping) into the sidewall section 20 of the spout portion 18 at equidistantly spaced intervals thereabout, and are disposed on a helical path of relatively course pitch. In a typical case in which the spout portion has a diameter of approximately one and five-eights inch, four segments 30 will be disposed at 90° intervals to provide a thread that makes less than a complete revolution thereabout and has a pitch of about one-eighth inch, and each segment will be about three-quarters inch long and one-quarter inch deep.

The housing subassembly 12 includes a relatively heavy gauge plastic sleeve member (fabricated, for example, by injection molding an acrylonitrile-butadine styrene, polyvinyl chloride, or polypropylene resin), consisting of a cylindrical sidewall portion 32, a radially extending circumferential flange portion 34 at the upper end of the sidewall portion, and a substantially tubular tail portion, generally designated by the numeral 34, at its lower end, the latter being connected through a conical transition section 36 of the sidewall portion 32. Thus, the sleeve member of the housing 12 is configured to conform substantially to the strainer body 10, but is of somewhat larger dimensions to provide a well 38 for seating the body 10. As can be seen, the sidewall portion 32 is formed with a series of axially extending ribs 40, which not only provide an enhanced gripping surface for tightening of the sleeve during assembly, but also serve to increase the overall strength and rigidity of the member.

The tail portion 34 of the sleeve member 12 has an upper section 42, of relatively large diameter, and a reduced diameter section 44 disposed downwardly from the section 42 and externally threaded to engage the plastic slip nut or coupling 46. The latter secures the tail piece flange 48 in a conventional and self-evident manner for connection of the drain pipe to the assembly, and is also formed with short axial ribs 47.

Figure 2:
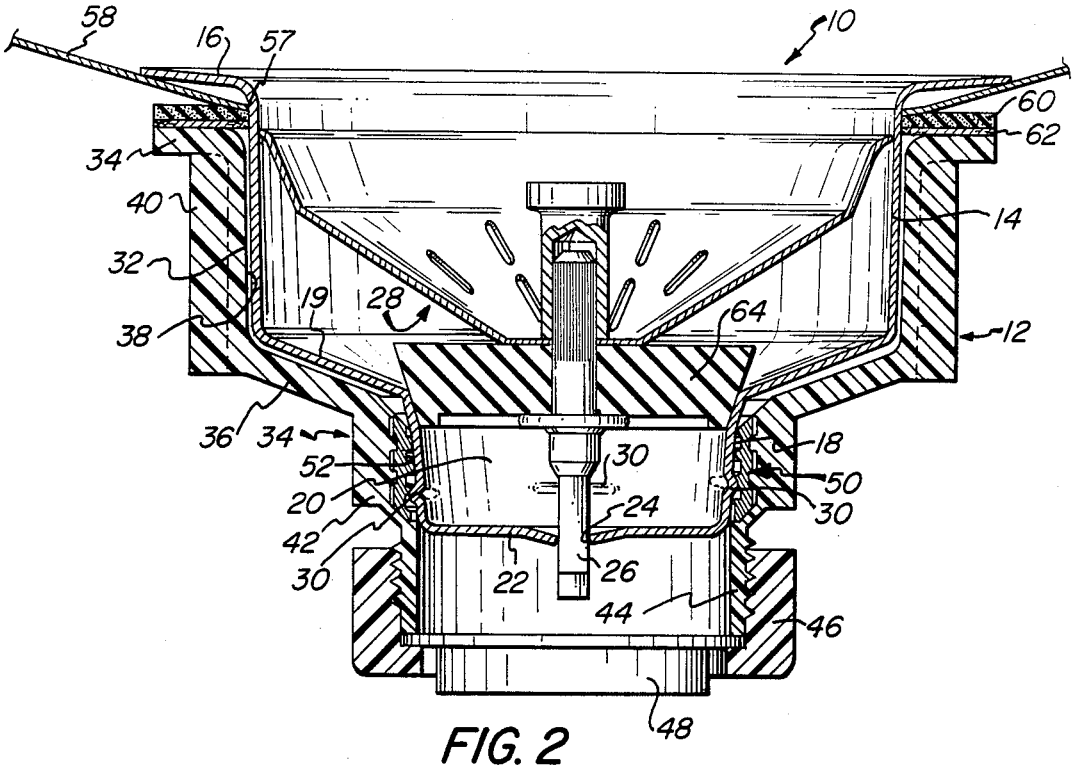
FIG. 2 is a vertical sectional view of the mounted assembly of FIG. 1.
Figure 4:
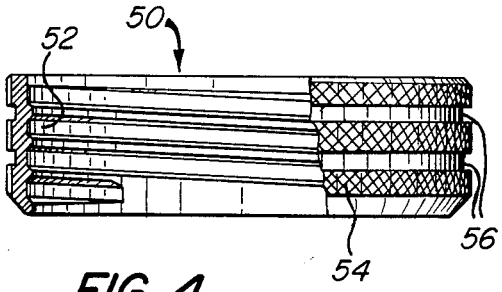
FIG. 4 is a side elevational view of the metal insert used in the housing of the assembly, with a portion broken away to show the internal thread structure.
Figure 3:
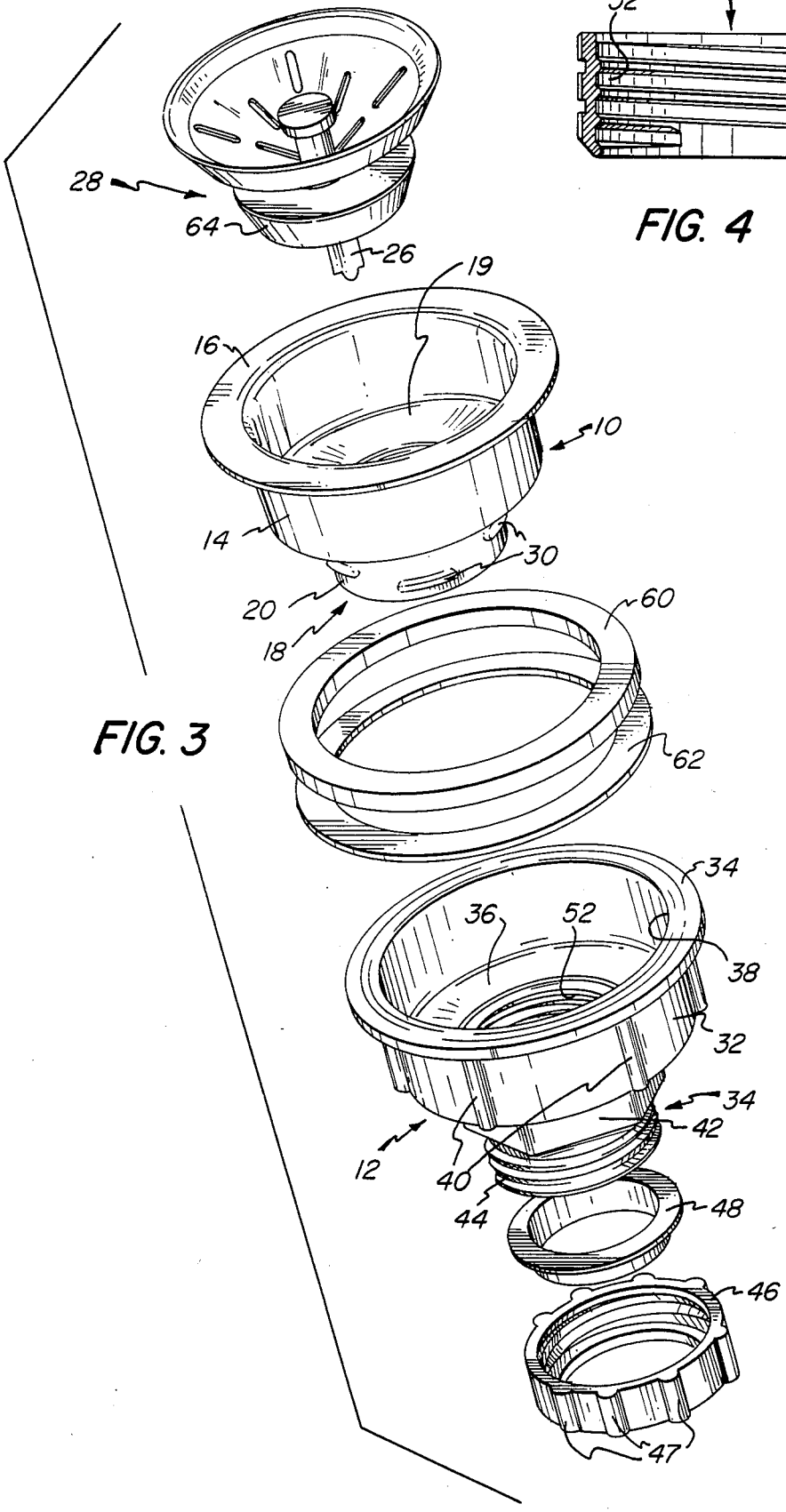
FIG. 3 is an exploded perspective view thereof, drawn to a reduced scale.

As best seen in FIG. 2, the enlarged section 42 of the tail portion 34 has permanently affixed therewithin (such as by molding during the course of producing the sleeve member 12) a metal ring insert, generally designated by the numeral 50 and most fully illustrated in FIG. 4; the insert will usually be made of aluminum, although other metals and comparable materials of construction can be substituted in appropriate circumstances. The insert 50 has a helical internal thread 52, which is of generally square cross section and makes several revolutions about its inner surface, and it has a configured outer surface portion 54 (both serration and knurling being shown for purposes of illustration) in which is formed a pair of circumferential grooves 56. The thread 52 serves of course to engage the segments 30 of the strainer body spout portion 18, which cooperatively provide the single-revolution thread thereabout, and the exterior surface configuration of the insert 50 functions to anchor it securely and permanently within the sleeve tail portion section 42, which is in turn strengthened by the insert. As will be noted, the ribs 40 on the sidewall portion 32 of the sleeve member allow use of a spanner wrench, and the upper section 42 of the tail portion is formed with a hexagonal external configuration to facilitate gripping by common wrenches, for final tightening of the housing 12 upon the strainer body 10.

The drain assembly is installed within the opening 57, defined by the surrounding portion 58 of the sink, simply by inserting the strainer body 10 therethrough until its flange portion 16 rests upon the sink surface. Following placement of rubber and paper washers 60, 62, respectively, about the sidewall portion 14, the housing 12 is attached by simply threading it upon the spout portion 18 of the stainer body 10, with the thread formations interengaged as described above. When the housing is tightened sufficiently upon the strainer body to ensure firm and secure mounting of the assembly, the drain conduit may be connected by engaging the coupling 46 upon the threaded section 44 to fasten the flange 48 thereagainst. The housing provides a unit of solid, one-piece construction between the bottom of the sink and the drain conduit, and effectively prevents leakage even if, for example, an insufficient amount of compound is used for sealing in the sink. The crumb basket/stopper unit 28 can then of course be placed into the strainer body for use in the normal manner, to either permit or prevent flow through the assembly, depending upon the position of the stopper 64.

As will be evident, the economy afforded by the invention is attributable primarily to the use of light gauge metal for the strainer body, instead of the heavy weight stampings or castings heretofore used to permit roll forming or cutting of threads. The present construction not only lowers materials costs, but it also makes the metal forming operations easier and thereby reduces the power demand. The spaced thread segments formed on the spout body are considerably easier to produce than is, for example, a rolled thread of several revolutions, and yet the structure provides a high level of strength, and secure and convenient installation in cooperation with the outer housing; other forms of thread means may however be substituted, as long as they are capable of functioning to afford the same advantages. Because the sleeve member is integrally formed as a single piece the housing subassembly is itself readily molded at relatively low cost, and the unique construction of the metal insert is especially desirable from the standpoint of producing firm securement within the plastic molding, as well as the desired coaction with the strainer body.

Thus, it can be seen that the present invention provides a novel drain assembly for installation in a sink or the like, which can be manufactured at substantially less cost than comparable constructions provided heretofore. Furthermore, the unique construction used causes no reduction in quality, durability, attractiveness, or facility of installation or use, as compared to similar prior art assemblies.

Having thus described the invention, what is claimed is:

1. A drain assembly for a sink, tub, basin, or similar vessel, including: a one-piece drain body of thin wall construction; and an external, two-piece housing comprised of a sleeve member integrally formed of a synthetic resinous material, and a ring-shaped metallic insert firmly secured therewithin; said drain body being comprised of a generally cylindrical sidewall portion, a circumferential flange portion extending outwardly about the upper end of said sidewall portion, and a reduced diameter tubular spout portion at the lower end thereof, said spout portion having thread means formed thereon for engagement with said insert of said housing, said sleeve member of said housing being dimensioned and configured to seat said drain body therewithin, said sleeve member having a circumferential flange portion and a generally cylindrical sidewall portion corresponding to said flange and sidewall portions of said drain body and a tail portion corresponding to said spout portion thereof, said circumferential flange portions of said drain body and housing being adapted to bear upon the opposed surfaces of the wall of an associated vessel about a drain opening therein to fix said drain assembly in position, said cylindrical portions of said body and housing extending in generally parallel relationship, said ring-shaped insert being disposed coaxially within said tail portion of said sleeve member adjacent said sidewall portion thereof and having an internal thread threadably engaged with said thread means of said spout portion to effect interengagement of said drain body and housing, said tail portion of said sleeve member having an externally threaded section extending below said insert to enable threaded connection of a drain conduit to said assembly.

2. The assembly of claim 1 wherein said drain body is fabricated from a single piece of light gauge metal sheet, and wherein said thread member extends helically for not more than a single revolution about said spout portion.

3. The assembly of claim 1 wherein said thread member consists of a plurality of discrete segments spaced from one another along a helical path.

4. The assembly of claim 1 wherein said ring-shaped insert is made of metal, and wherein the internal threads thereof are of generally square cross-section.

5. The assembly of claim 1 wherein said sidewall portion of said drain body has a conical throat section leading to said spout portion, and wherein said sidewall portion of said sleeve member has a corresponding throat section leading to said tail portion thereof.

6. The assembly of claim 1 wherein the section of said housing sleeve member within which said insert is disposed is of enlarged cross section relative to said externally threaded section, the inside diameters of said enlarged and threaded sections being substantially the same so as to provide a passage of generally uniform diameter through said tail portion.

7. The assembly of claim 6 wherein said enlarged section of said tail portion has a polygonal exterior configuration for facile engagement by a wrench for tightening of said housing upon said drain body.

8. A drain assembly for a sink, tub, basin, or similar vessel, including: a one-piece drain body of thin wall metal construction; and an external, two-piece housing comprised of a sleeve member integrally formed of a synthetic resinous material, and a ring-shaped insert firmly secured therewithin; said drain body being comprised of a generally cylindrical sidewall portion, a circumferential flange portion extending outwardly about the upper end of said sidewall portion, and a reduced diameter tubular spout portion at the lower end thereof, said sidewall portion including a conical throat section leading to said spout portion, said spout portion having thread means formed thereon for engagement with said insert of said housing and making no more than a single revolution thereabout, said sleeve member of said housing being dimensioned and configured to seat said drain body therewithin, said sleeve member having a circumferential flange portion and a generally cylindrical sidewall portion corresponding to said flange and sidewall portions of said drain body, and a tail portion corresponding to said spout portion thereof, said circumferential flange portions of said drain body and housing being adapted to bear upon the opposed surfaces of the wall of an associated vessel about a drain opening therein to fix said drain assembly in position, said cylindrical portions of said body and housing extending in generally parallel relationship, said ring-shaped insert being disposed coaxially within said tail portion of said sleeve member adjacent said sidewall portion thereof and having an internal thread threadably engaged with said thread means of said spout portion to effect engagement of said drain body and housing, said tail portion of said sleeve member having an externally threaded section extending below said insert to enable threaded connection of a drain conduit to said assembly.

9. The assembly of claim 8 wherein said thread member consists of a plurality of discrete segments spaced from one another along a helical path, and wherein the internal threads of said insert are of generally square cross-section.

* * * * *